US008240263B1

(12) United States Patent
Frost et al.

(10) Patent No.: US 8,240,263 B1
(45) Date of Patent: Aug. 14, 2012

(54) METHOD FOR SELECTIVE DISPLAY OF YARN IN A TUFTED FABRIC

(75) Inventors: Steven L. Frost, Signal Mountain, TN (US); Mike Bishop, Signal Mountain, TN (US); Brian K. Lovelady, Soddy Daisy, TN (US)

(73) Assignee: Tuftco Corporation, Chattanooga, TN (US)

( * ) Notice: Subject to any disclaimer, the term of this patent is extended or adjusted under 35 U.S.C. 154(b) by 412 days.

(21) Appl. No.: 12/561,179

(22) Filed: Sep. 16, 2009

Related U.S. Application Data

(60) Provisional application No. 61/097,461, filed on Sep. 16, 2008.

(51) Int. Cl.
*D05C 15/00* (2006.01)

(52) U.S. Cl. ..... 112/475.23

(58) Field of Classification Search ..... 112/475.23, 112/2.2, 98, 103, 220, 221, 80.5, 80.01, 80.08, 112/7, 475.19
See application file for complete search history.

(56) References Cited

U.S. PATENT DOCUMENTS

| | | | | |
|---|---|---|---|---|
| 4,103,629 | A | 8/1978 | Card | |
| 4,549,496 | A | 10/1985 | Kile | |
| 4,557,208 | A | 12/1985 | Ingram | |
| 5,080,028 | A * | 1/1992 | Ingram | 112/80.08 |
| 5,165,352 | A * | 11/1992 | Ingram | 112/80.08 |
| 5,566,630 | A | 10/1996 | Burgess | |
| 5,983,815 | A * | 11/1999 | Card | 112/80.73 |
| 6,224,203 | B1 | 5/2001 | Wotton | |
| 6,439,141 | B2 | 8/2002 | Morgante | |
| 6,550,407 | B1 | 4/2003 | Frost | |
| 6,877,449 | B2 * | 4/2005 | Morgante et al. | 112/475.23 |
| 7,222,576 | B2 | 5/2007 | Kilgore | |
| 7,634,326 | B2 * | 12/2009 | Christman et al. | 700/131 |
| 7,814,850 | B2 * | 10/2010 | Bearden | 112/80.4 |
| 2009/0205547 | A1 | 8/2009 | Hall | |

FOREIGN PATENT DOCUMENTS

| | | |
|---|---|---|
| GB | 853943 | 11/1960 |
| GB | 859761 | 1/1961 |
| GB | 920023 | 3/1963 |
| GB | 1039857 | 8/1964 |
| GB | 2050447 | 1/1981 |
| GB | 2246371 | 1/1992 |
| WO | WO 9612843 | 5/1996 |

* cited by examiner

*Primary Examiner* — Tejash Patel
(74) *Attorney, Agent, or Firm* — Miller & Martin PLLC

(57) ABSTRACT

A method of tufting novel loop pile carpets is provided to allow the use of four or more colors of yarn at sufficient stitch density to provide for a solid appearance of any of the selected colors at any location on the carpet.

20 Claims, 5 Drawing Sheets

METHOD FOR SELECTIVE DISPLAY OF YARN IN A TUFTED FABRIC

The present application claims priority to the Sep. 16, 2008 filing date of U.S. provisional patent application Ser. No. 61/097,461, which is incorporated herein.

FIELD OF THE INVENTION

The present invention relates to the operation of the tufting machines and is more particularly concerned with method for operating a tufting machine to produce a tufted fabric that displays selected yarns while concealing other yarns to produce novel carpet designs.

BACKGROUND OF THE INVENTION

The tufting industry has long sought easy and efficient methods of producing new visual patterns on tufted fabrics. In particular, the industry has sought to tuft multiple colors so that any selected yarns of multiple colors could be made to appear in any desired location on the fabric. Significant progress toward the goal of creating carpets and tufted fabrics selectively displaying one of a plurality of yarns came with the introduction of a servo motor driven yard feed attachments. Notable among these attachments are the servo scroll attachment described in Morgante, U.S. Pat. No. 6,224,203 and related patents; the single end servo scroll of Morgante, U.S. Pat. No. 6,439,141 and related patents; and the double end servo scroll of Frost, U.S. Pat. No. 6,550,407.

In operation the servo scroll yarn feed attachment, when alternating needles are threaded with A and B yarns respectively, allows the control of tufting of heights of yarns so that at a given location on the surface of the tufted fabric, either or both of the A and B yarns is visible. The implementation of the single end scroll of pattern attachment, and the similar double end servo scroll pattern attachment, permitted the tufting machine to be configured with A and B yarns fed to alternating needles on a front needle bar while C and D yarns were fed to alternating needles on a rear needle bar in order to create color representations on tufted fabrics. These efforts suffered from the difficulty that if a solid area of one color was to be displayed, only one of every four stitches was tufted to substantial height and the remaining three colors were "buried" by tufting the corresponding yarn bights to an extremely low height. With only one of four stitches emerging to substantial height above the backing fabric, the resulting tufted fabric had inadequate face yarn for general acceptance.

The principal alternative to this configuration has been the use of a pneumatic system to direct one of a plurality of yarns through a hollow needle on each stitch of tufting machine, as typified by U.S. Pat. No. 4,549,496. These hollow needle, pneumatic tufting machines are generally most suitable for producing cut pile tufted fabrics and have been subject to limitations involving the sizes of fabrics that can be tufted, the production speed for those fabrics, and the maintenance of the tufting machines due to the mechanical complexity attendant to the machines' operation. Accordingly, the tufting industry has had a long felt need for a tufting machine that could operate efficiently to display one of several yarns at a selected location while maintaining a suitable density of yarns and operating at speeds approaching those of conventional tufting machines.

It should be noted that the pneumatic tufting machines utilizing hollow needles as in U.S. Pat. No. 4,549,496 generally tuft laterally for between about one-half to four inches before backing fabric is advanced. Because the yarn being tufted is cut at least every time the color yarn being tufted through a particular needle is changed, there is no unnecessary yarn placed as back stitches on the bottom of the tufted fabric. However, when attempts have been made to utilize a regular tufting machine configuration with a needle bar carrying a transverse row of needles in a similar fashion, the yarns are not selected for tufting and cut after tufting, but instead each yarn is tufted in every reciprocal cycle of the needle bar. Therefore yarn carrying needles all penetrate the backing fabric on every cycle. The yarns are selected for display by a yarn pattern device feeding the yarn to be displayed and backrobbing the yarns that are not to be visible thereby burying the resulting yarn bights or tufts very close to the surface of the backing fabric. If several stitches are made as the needle bar moves laterally with respect to the backing fabric, then back stitch yarn for each of the colors of yarn is carried for each stitch and this results in considerable "waste" of yarn on the bottom of the resulting tufted fabric.

To overcome these difficulties, three methods of configurating and operating tufting machines of conventional design have been devised for the placement of color yarns.

In a first alternative, a loop pile fabric can be created selectively displaying one of three or more distinct yarns in the following fashion. Using the example of a thread-up featuring four yarns that have distinct colors, an inline needle bar, typically of about $1/10^{th}$ gauge is threaded with a repeat of A, B, C, D over every four needles. The tufting machine is programmed to tuft four stitches laterally before advancing the backing fabric. In this fashion, each of the four adjacent needles threaded with yarns A, B, C, and D respectively will penetrate the backing fabric at nearly the same position. On those four cycles of the needles penetrating the backing fabric, adequate yarn will be fed to the color that is desired to predominate visually by the associated servo motor. Sufficient yarn is fed to allow the yarn bight to be tufted at a relatively high level. The other yarns are backrobbed in order to bury their associated yarn bights at a relatively low level. After tufting the four lateral cycles, the backing fabric is advanced and the four lateral stitch cycle is repeated with the needle bar moving in the opposite direction. It can be seen that this method, although functional, results in excess yarn on the bottom of the tufted fabric compared to ordinary tufted fabrics, and requires that the tufting machine operate only at about one-fourth the speed that it would operate if tufting conventional fabric designs.

In a second alternative it is possible to create a similar color placement effect in a cut/loop pile fabric utilizing the level cut loop configuration of U.S. Pat. No. 7,222,576 tufted on a tufting machine having about a $1/10^{th}$ gauge needle bar with a four color repeating thread-up. The tufting machine is operated to tuft laterally four times and allows the color chosen for display to be either a cut or loop bight while backrobbing the yarn colors not to be shown on the face of the carpet, and leaving only very low tufts of those yarns. Obviously, three or more than four different yarns may be used in the thread-up with a corresponding adjustment in the number of lateral shifts. In this method of operation, there is again considerable excess yarn carried on the bottom of the backing fabric.

Both the first and second alternatives are essentially the same techniques that have been utilized with two colors of yarn on a widespread basis in the tufting industry in past years. Although multiple cycles of lateral shifting presents some issues not present when shifting only a single lateral step, the principal issue is one of avoiding overtufting or sewing exactly in the same puncture of the backing fabric made by a previous cycle of a nearby needle. This is typically addressed by using one or both of positive stitch placement and continuous, but reduced speed, backing fabric feed.

An additional problem presented by the first and second alternative techniques is the sheer number of penetrations of the backing fabric which results in degradation or slicing of nonwoven backing fabric materials that are commonly utilized in the manufacture of tufted fabrics for carpet tiles and special applications such as automotive carpets.

Finally, to overcome these shortcomings, a novel third alternative to produce similar fabrics with yarn placement is achieved with a staggered needle configuration having front and rear rows of needles offset or staggered from one another. A staggered needle bar typically consists of two rows of needles extending transversely across the tufting machine. The rows of needles are generally spaced 0.25 inches apart in the longitudinal direction and are offset so that the needles in the rear transverse row are longitudinally spaced between the needles in the front transverse row. Alternatively, two sliding needle bars each carrying a single transverse row of needles may be configured in a staggered alignment. In operation the needle bar is reciprocated so that the needles penetrate and insert loops of yarn in a backing material fed longitudinally beneath the needles. The loops of yarn are seized by loopers or hooks moving in timed relationship with the needles beneath the fabric. In most staggered needle bar tufting machines, there are front loopers which cooperate with the front needles and rear loopers which cooperate with the rear needles. In a loop pile machine, it may be possible to have two separate rows of loopers such as those illustrated in U.S. Pat. No. 4,841,886 where loopers in the front hook bar cooperate with the front needles and loopers in the rear hook bar cooperate with rear needles. Similar looper constructions have been used in tufting machines with separate independently shiftable front and rear needle bars, so that there are specifically designated front loopers to cooperate with front needles and specifically designated rear loopers to cooperate with rear needles. To achieve maximum stitch density, and to minimize the possibility of tufting front and rear needles through the same penetrations of the backing fabric, it is desirable to offset the front loopers from the rear loopers by a half gauge unit.

The result of having loopers co-operable with only a given row of needles on a fine gauge tufting machine with either a staggered needle bar or two independently shiftable needle bars is that it is only possible to move a particular needle laterally by a multiple of the gauge of the needles on the relevant needle bar. Thus for a fairly common 0.20 inch ($1/5^{th}$) gauge row of needles with corresponding loopers set at 0.20 inch gauge, the needles must be shifted in increments of 0.20 inches. This is so even though in a staggered needle bar with two rows of 0.20 inch gauge needles the composite gauge of the staggered needle bar is 0.10 inch gauge. The necessity of shifting the rows of needles twice the gauge of the composite needle assembly results in patterns with less definition than could be obtained if it were possible to shift in increments of the composite gauge.

One effort to reduce the gauge of tufting has been to use smaller and more precise parts. Furthermore, in order to overcome the problem of double gauge shifting, U.S. Pat. No. 5,224,434 suggests a tufting machine with front loopers spaced equal to the composite gauge and rear loopers spaced equal to the composite gauge. Thus on a tufting machine with two rows of 0.20 inch gauge needles there would be a row of front loopers spaced at 0.10 inch gauge and a row of rear loopers spaced at 0.10 inch gauge. Although this allows the shifting of each row of needles in increments equal to the composite gauge, this solution was limited in that the front needles can only be used to create loop pile and the rear needles can only be used to create cut pile.

Staggered needle bar tufting machines are commonly for the tufting of solid color carpets, often using relatively inexpensive yarns. Inexpensive yarns may contain streaks of lighter or darker color. By shifting a staggered needle bar threaded with a single color of yarns, the yarns from the first transverse row of needles will cross with the yarns from the second transverse row of needles and any streaks in a yarn will be tufted in rows with yarns from other needles so that streaking will not be apparent in the finished carpet. However, the staggered needle bar tufting machine has not been viewed as conclusive to use for varied color patterns.

SUMMARY OF THE INVENTION

The present invention is addressed to techniques allowing a tufting machine to be threaded with three, four, or possibly even more colors of yarn, and to display selected colors at any location on the face of the carpet, while burying other yarn colors, maintaining adequate face yarn density, and minimizing unnecessary yarns on the back of the backing fabric

BRIEF DESCRIPTION OF THE DRAWINGS

Particular features and advantages of the present invitation will become apparent from the following description when considered in conjunction with the accompanying drawings in which.

DETAILED DESCRIPTION OF THE INVENTION

Figure 1:
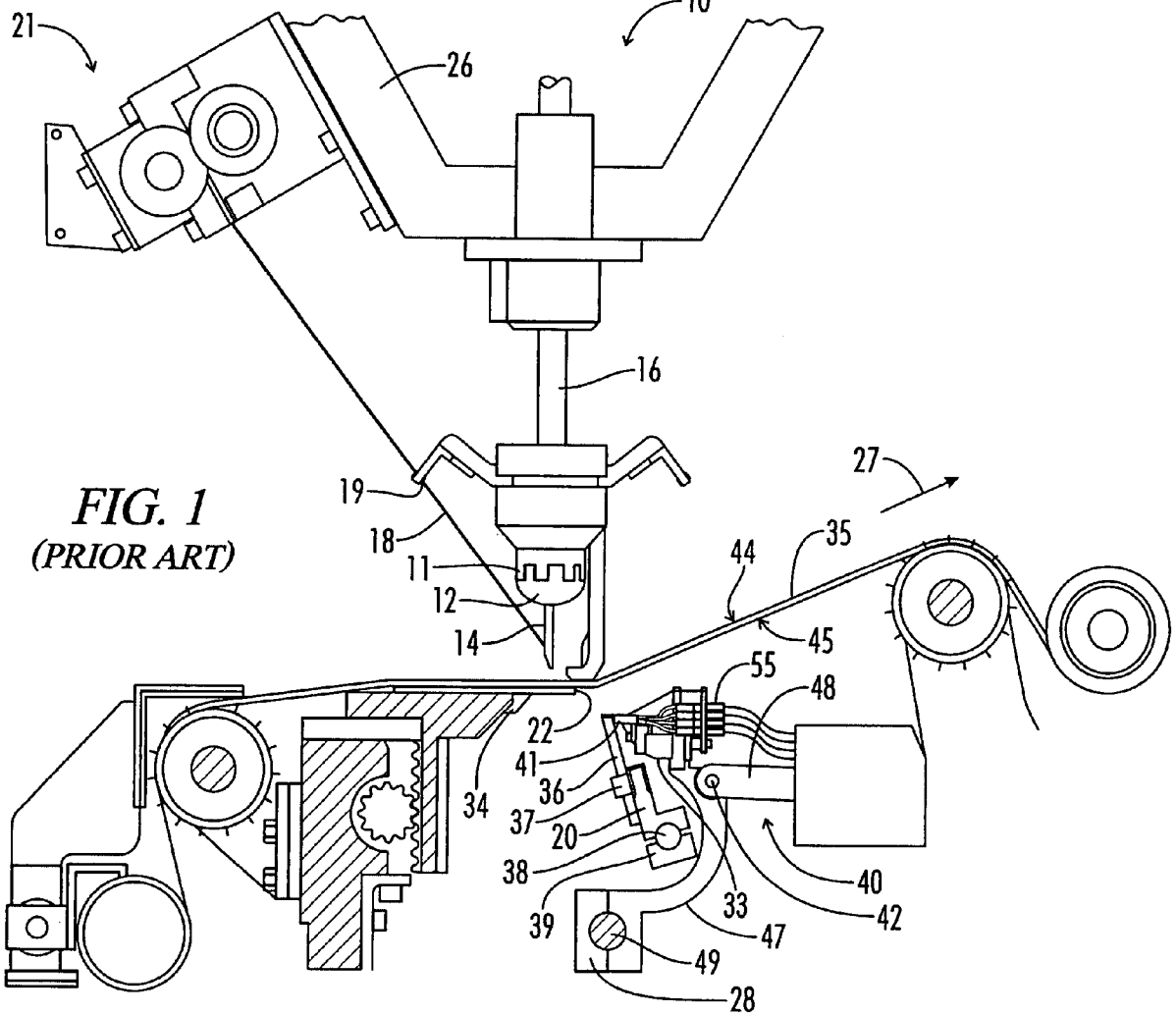
FIG. 1 (PRIOR ART)
FIG. 1 is a partial sectional end view of a prior art tufting machine that can be operated to place colored yarns in the manufacture of fabrics with cut and loop face yarns.

Referring now to the drawings in more detail, FIG. 1 discloses a multiple needle tufting machine 10 including an elongated transverse needle bar carrier 11 supporting a needle bar 12. The needle bar 12 supports a row of transversely spaced needles 14. The needle bar carrier 11 is connected to a plurality of push rods 16 adapted to be vertically reciprocated by conventional needle drive mechanism, not shown, within the upper housing 26.

Yarns 18 are supplied to the corresponding needles 14 through corresponding apertures in the yarn guide plate 19 from a yarn supply, not shown, such as yarn feed rolls, beams, creels, or other known yarn supply means, preferably passing through pattern yarn feed control 21.

The needle bar 12 may be fixedly mounted to the needle bar carrier 11 or may slide within the needle bar carrier 11 for transverse or lateral shifting movement by appropriate pattern control needle shifter mechanisms, in well known manners. The backing fabric 35 is supported upon the needle plate 34 having rearward projecting transversely spaced front needle plate fingers 26, the fabric 35 being adopted for longitudinal movement from front-to-rear in a feeding direction, indicated by the arrow 27, through the tufting machine 10.

The needle drive mechanism, not shown, is designed to actuate the push rods 16 to vertically reciprocate the needle bar 12 to cause the needles 14 to simultaneously penetrate the backing fabric 35 far enough to carry the respective yarns 18 through the backing fabric 35 to form loops on the face thereof. After the loops are formed, the needles 14 are vertically withdrawn to their elevated, retracted positions. A yarn seizing apparatus 40 in accordance with this invention includes a plurality of gated hooks 41, there preferably being one gated hook 41 for each needle 14.

Each gated hook 41 is provided with a shank received in a corresponding slot in a hook bar 33 in a conventional manner. The gated hooks 41 have the transverse spacing or gauge as the needles 14 and are so arranged that the bill of each hook 42 is adapted to cross and engage its corresponding needle 14 when the needle 14 is in its lower most position. Gated hooks 41 seize the yarn 18 and form a loop therein when the sliding gate is closed by an associated pneumatic cylinder 55, and to shed the loop as the gated hooks 41 are rocked.

The elongated, transverse hook bar 33 and associated pneumatic assembly are mounted on the upper end portion of a C-shaped rocker arm 47. The lower end of the rocker arm 47 is fixed by a clamp bracket 13 to a transverse shaft 49. The upper portion of the rocker arm 47 is connected by a pivot pin 42 to a link bar 48, the opposite end of which is connected to be driven or reciprocally rotated by conventional looper drive. Adapted to cooperate with each hook 41 is a knife 36 supported in a knife holder 37 fixed to knife block 20. The knife blocks 20 are fixed by brackets 39 to the knife shaft 38 adapted to be reciprocally rotated in timed relationship with the driven rocker arm 47 in a conventional manner. Each knife 36 is adapted to cut loops formed by each needle 14 upon the bill of the hook 41 from the yarn 18 when gates are retracted and yarn loops are received on the hooks 41. The preferred gated hook assembly is disclosed in U.S. Pat. No. 7,222,576 which is incorporated herein by reference.

In order to reduce the likelihood of needles from one cycle of tufting entering the exact same openings that were tufted on a previous cycle, a technique referred to in the tufting industry as "positive stitch placement" may be utilized. In this procedure, the needles are shifted slightly out of line with their associated loopers and the needles begin their downward path until engaging in the backing fabric. Once engaged in the backing fabric, the needles are moved by a shifting apparatus into their proper alignment with associated loopers and the needles continue their downward path carrying yarns through the backing fabric and the yarns are seized by the loopers. Cam shifters, roller screw shifters, and hydraulic shifters may be used for this purpose.

An additional technique that may minimize the lateral yarns on the backstitch side of the tufted fabric involves backrobbing yarns that are not being tufted at a height intended to display the resulting yarn tufts. If the yarn is backrobbed to the extent that there is no tuft bind and the yarn lays flat across the backing fabric, the yarn used between visible stitches is reduced. So long as the yarn is periodically left penetrating the backing fabric, at least about every fourth or fifth stitch (and most preferably, every alternate stitch), the yarn used to carry "buried" yarns from one display location to another may be reduced.

Figure 2A:
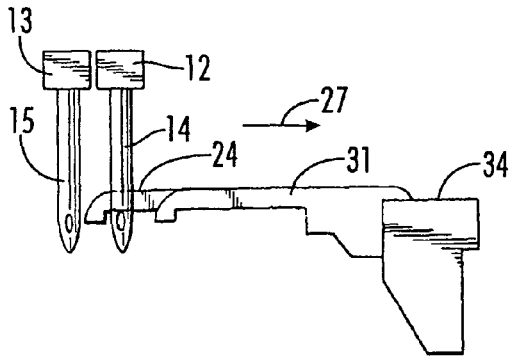
FIG. 2A (PRIOR ART)
FIG. 2A is a side elevation view of a prior art needle and looper assembly for making cut pile carpet with two transverse rows of longitudinally offset needles.

FIG. 2A shows a prior art cut pile tufting machine with front needle bar 12 supporting front needles 14 and rear needle bar 13 supporting rear needles 15 in a lower yarn loop seizing position. Backing fabric, not shown, is fed over needle plate in direction 27 and supported by needle plate fingers in the area where needles 14 and 15 penetrate the backing fabric. When needles 14 and 15 are driven downward into the lower position by conventional means to penetrate the backing fabric, front loopers 31 and rear loopers 36 mounted in looper bar 34 are reciprocated to cross front needles 14 and rear needles 15 respectively.

Figure 2B:
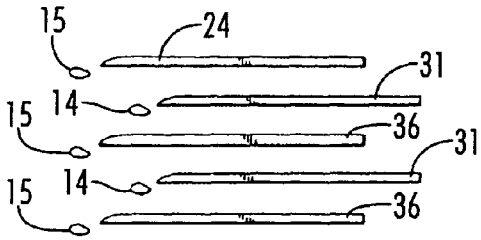
FIG. 2B (PRIOR ART)
FIG. 2B is a top sectional view of the prior art needle and looper assembly of FIG. 2A.

The looper bar 34 is reciprocated by conventional means, not shown, acting on a rocker shaft, so that loopers 31 and 36 seize loops of yarn which are cut as they move rearward, thereby forming cut pile tufts on the bottom surface of the backing fabric. FIG. 2B shows the arrangement of needles 14 and 15, and loopers 31 and 36 from a top view. This configuration of needles and loopers is not adequate for tufting the multi-yarn fabrics of the present invention because the front needles 14 are shiftable only on the gauge units of their loopers 31 and the rear needles 15 are shiftable only on the gauge units of their loopers 36. Accordingly, yarn penetrations of sufficient density to allow a single yarn of four possible colors to produce a solid appearance are not achieved. In order to tuft the widest variety of patterns with four colors of yarn, it is necessary that the pattern control yarn feeds be able to display any one or more of the available colors of yarn at any location on the carpet, and to achieve sufficient stitch density that when only a single color yarn is displayed on the face of the fabric, the visual appearance is that of a substantially solid color.

Figure 3A:
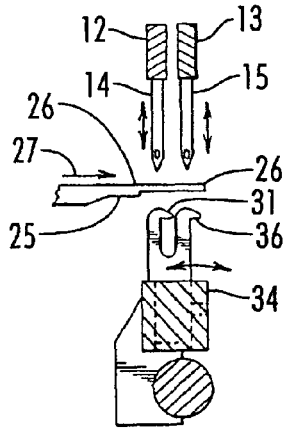
FIG. 3A (PRIOR ART)
FIG. 3A is a side elevation view of a second prior art needle and looper assembly for making loop pile carpet with two transverse rows of longitudinally offset needles.

In FIG. 3A, an alternative prior art loop pile tufting machine is shown with front needle bar 12 supporting front needles 14 and rear needle bar 13 supporting rear needles 15 in an upper position. Backing fabric, not shown, is fed over a needle plate 25 in direction 27 and is supported by needle plate fingers 26 in the area where needles 14 and 15 penetrate the backing fabric. When needles 14 and 15 are driven downward into a lower position by conventional means to penetrate the backing fabric, the front loopers 31 and rear loopers 36 mounted in looper bar 34 are reciprocated to cross front needles 14 and rear needles 15 respectively.

Figure 3B:
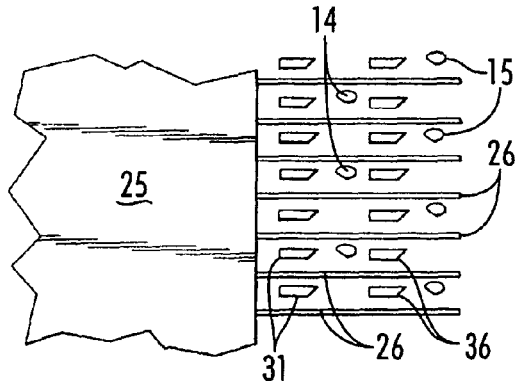
FIG. 3B (PRIOR ART)
FIG. 3B is a top sectional view of the prior art needle and looper assembly of FIG. 3A.

The looper bar 34 is reciprocated by conventional means, not shown, acting on a rocker shaft, so that loopers 31 and 36 seize and release loops of yarn thereby forming loop pile tufts on the bottom surface of the backing fabric. FIG. 3B shows the arrangements of needles 14 and 15, and loopers 31 and 36 from a top view. It will be seen that the front and rear loopers 31 and 36 are in line, but the needles may shift in single gauge units. By way of example, the illustrated front needles 14 may be spaced at $\frac{1}{5}^{th}$ gauge and the loopers 31 are therefore spaced at $\frac{1}{10}^{th}$ gauge. In this example, the front needles 14 may be shifted in $\frac{1}{10}^{th}$ gauge increments. A disadvantage to this particular arrangement is that the front and rear gauge positions are directly in line. This may cause over sewing where front and rear yarns are tufted in the same openings in the backing material, resulting in an irregular appearance of yarns on the face.

Figure 4:
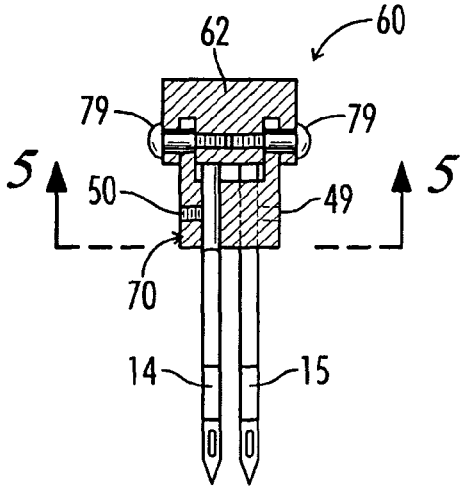
FIG. 4 is a sectional end view of a prior art staggered needle bar.
Figure 5:
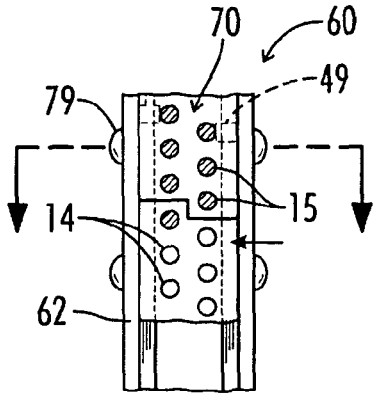
FIG. 5 is a bottom plan view of a segment of the staggered needle bar of FIG. 4.

In addition to the use of two separate needle bars, an alternative method of utilizing two rows of needles for tufting is the use of a staggered needle bar assembly 60 shown, for example, in FIGS. 4 and 5. In the illustrated staggered needle bar assembly, a mounting bar 62 is utilized to hold needle bar segments 70. In the exemplary embodiment of a staggered needle bar, needles 14 and 15 are held in place by set screws 50 and 49 and segments 70 are secured by bolt members 79. Front needles 14 may be threaded with A,B colors and rear needles 15 may be threaded with C,D colors to minimize backstitch yarns. Each group of A, B, C, and D colors may be referred to as a repeat, just as four adjacent needles in a single needle bar configuration would comprise a repeat.

Figure 7:
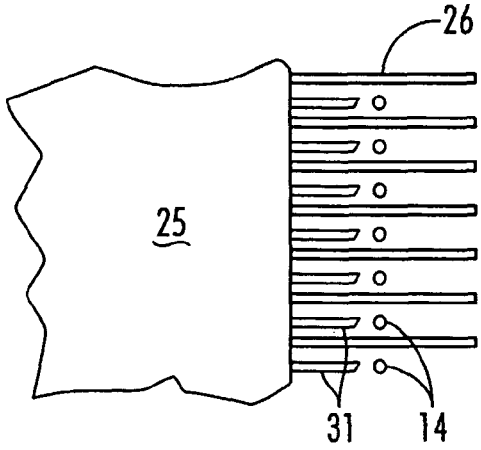
FIG. 7 is a top sectional view of a single row of needles and loopers.
Figure 8A:
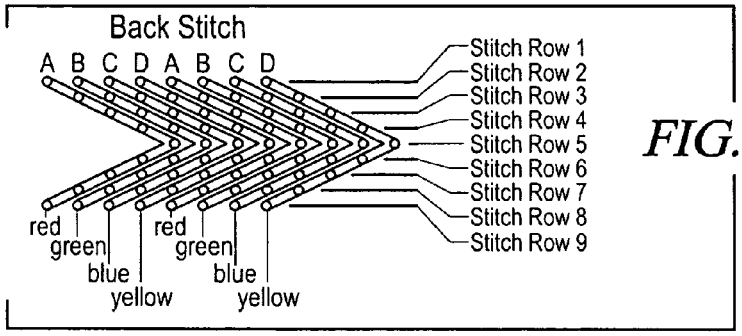
FIG. 8A is a schematic illustration of the back stitching on a backing fabric tufted by moving a needle bar with an A, B, C, D thread-up laterally for four stitches.
Figure 8B:
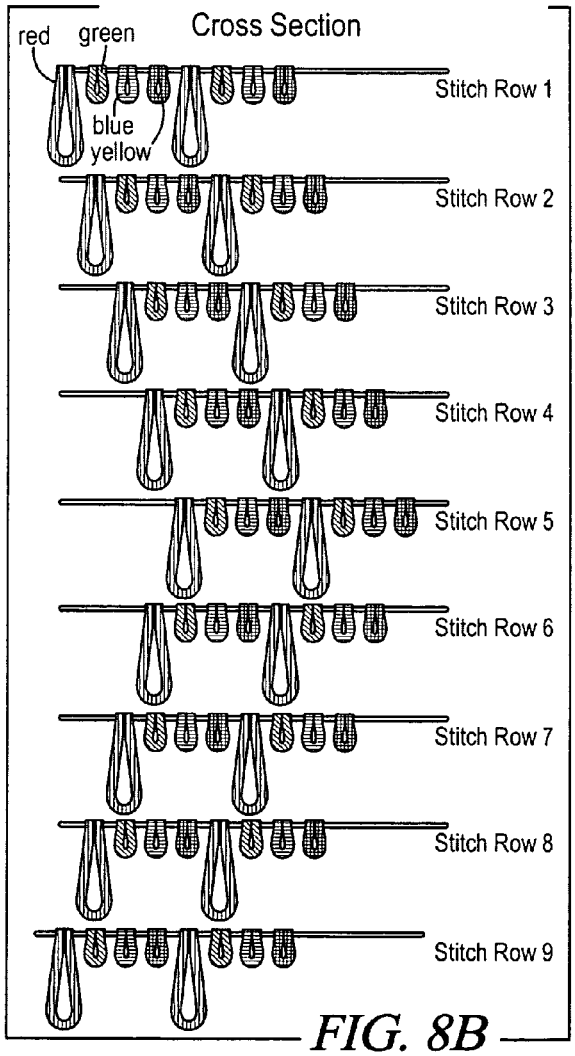
FIG. 8B is a sectional view of the fabric of FIG. 3A.
Figure 8C:
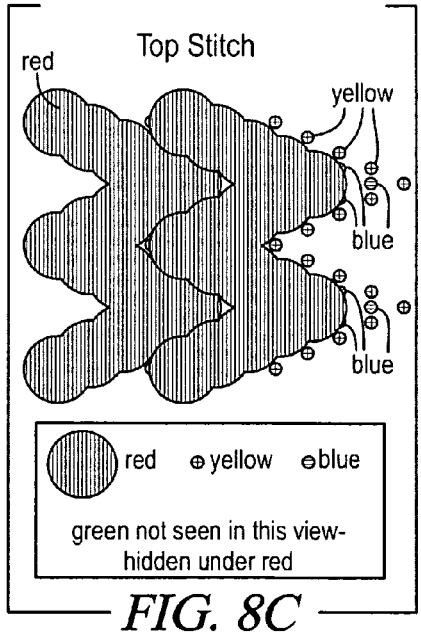
FIG. 8C is a schematic illustration of the face of the fabric of FIG. 3A.

FIG. 7 is a top view of a needle bar with a single row of needles 14 associated with loopers 31 and where a backing fabric, not shown, would pass over needle plate 25 and needle plate fingers 26 for tufting. To create a carpet with more than two colors of yarn and a sufficient stitch density when all but one of the colors is buried, a single row of needles 14 as illustrated in FIG. 7, must generally be tufted laterally in four steps as represented in the backstitch illustration of FIG. 8A. Thus, if carpet were being tufted with eight longitudinal rows of stitches per inch, this method of tufting requires that the single needle bar threaded with A, B, C, and D yarns be tufted through four cycles as the backing fabric advances $1/8^{th}$ of an inch. Although the backing fabric could be halted for the four stitches and then indexed to advance an eighth of an inch, it is generally preferred to keep the backing advancing but at a reduced speed. This helps minimize the possibility of over-sewing. Next the shifting of the needle bar is reversed for the following four cycles of tufting while the backing fabric is again advanced another $1/8^{th}$ of an inch. This technique produces sufficient stitch density to provide good coverage of the face of the fabric by a single yarn color as illustrated in top stitch view of the face of the resulting fabric in FIG. 8C. FIG. 8B shows a cross section of each row of stitches. The illustrated nine rows of stitches have to be longitudinally compressed to fit in a space where ordinarily only slightly more than two rows of stitches would otherwise be placed.

This single row of needles yarn thread up also benefits from the use of positive stitch placement and the backrobbing of yarns on at least selected stitches from the colors of yarn that are not intended to be displayed on the face of the carpet as described above. However, use of this technique to produce four color tufted fabrics with solid areas of color suffers drawbacks. For instance, tufting of fabric is slow due to the necessity to shift the needle bar laterally four times before advancing the length of a full row of stitches. In addition, the close penetrations of the needles will slice some nonwoven backing fabrics that are desirable for use in carpet tile and other special applications.

Figure 6:
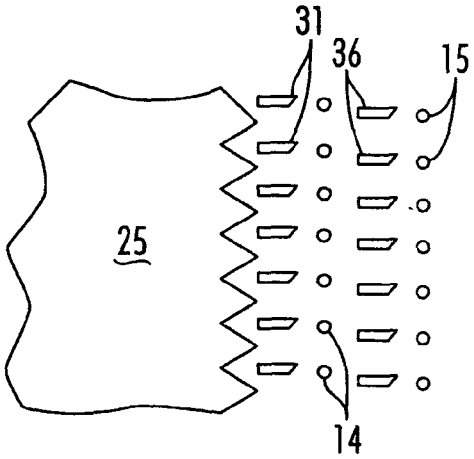
FIG. 6 is a top sectional view of a fine gauge needle and looper arrangement with the needles and loopers of each row offset from one another.

Accordingly, arrangement of front loopers 31 and front needles 14 offset by a half gauge from rear loopers 36 and rear needles 15 is most desirable, as shown in FIG. 6. This configuration contemplates separate loopers rather than the design shown in FIG. 3A so that the front loopers 31 may be offset a half gauge from the rear loopers 36. For typical yarns, the gauge of both the front and rear needles 14 and 15 may be $1/10^{th}$ gauge, however, for thicker yarns, a wider spacing such as 5/32nds gauge for each row of needles may be desired. When utilizing the two rows of $1/10^{th}$ gauge needles as illustrated in the set up of FIG. 6, which may be on separate needle bars or on a staggered needle bar configuration as illustrated in FIGS. 4 and 5, it is possible to tuft a four color yarn threadup at much greater speeds than using a single needle bar and much less yarn is wasted on the bottom of the backing fabric with lateral stitching.

Figure 9A:
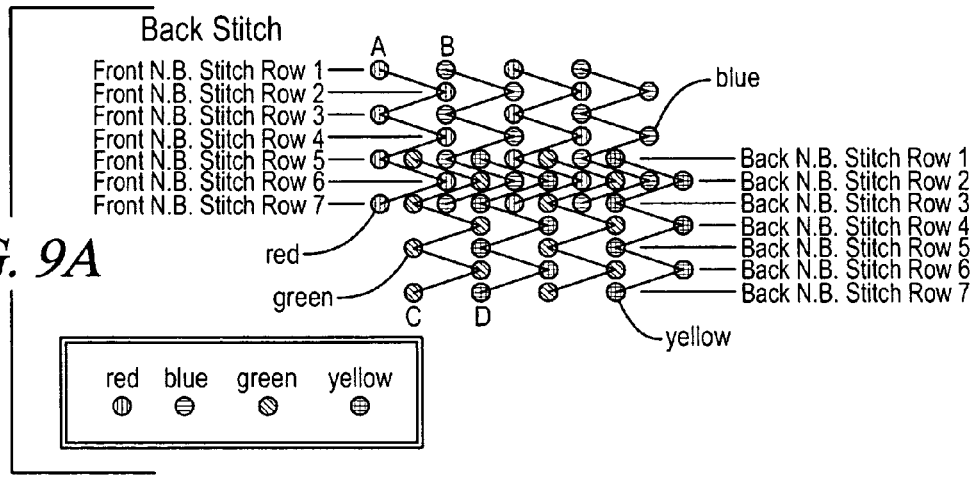
FIG. 9A is a schematic illustration of the back stitching on a backing fabric tufted moving a staggered needle bar laterally for only one stitch, with an A, B front row and C, D back row thread-up.
Figure 9B:
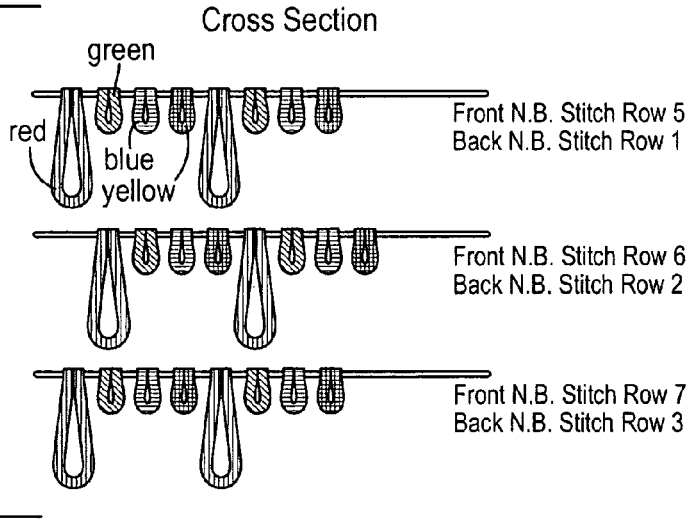
FIG. 9B is a sectional view of the fabric of FIG. 9A.
Figure 9C:
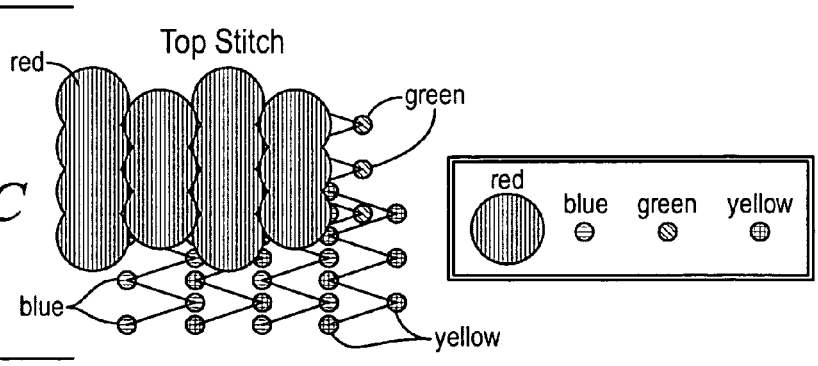
FIG. 9C is a schematic illustration of the face of the fabric of FIG. 9A.

As shown in FIG. 9A, front needles may be threaded with A and B yarns and rear needles may with threaded with C and D yarns, to form a repeat. In operation, the backing fabric is fed at a about one-half the usual speed and the needle bars are shifted laterally one step, back and forth, with each reciprocation of the needle bar. In this fashion, the front needles 14 are not aligned with the penetrations of the rear needles 15 and the amount of yarn that is utilized in the lateral positioning of the tufting is greatly reduced from the single needle bar arrangement where four lateral steps are required. Only two rows of stitching are required to produce the equivalent of a row of tufts created in the customary AB yarn threadup where only one of the two colors is subject to being buried. As shown in FIG. 9C, the coverage of the single yarn, A in the illustration, is adequate to produce a pleasing solid color effect. The pattern created by this alignment of needles and tufting is also suitable not merely for woven backing fabrics but also for nonwoven materials. Thus, the fine line setup of two relatively fine gauge needle bars for the type of yarn being tufted, such as $1/10^{th}$ gauge for regular yarns, with loopers offset between front and rear needles by one-half gauge, is most desirable for use with pattern controlled yarn feeds to create a four color tufted carpet design with loop pile tufts and solid color areas. It would also be possible to create six color fabrics by using an A, B, C thread up on the front needles and an D, E, F thread up on the rear needles to form a six color repeat and shifting two lateral steps in each direction.

All publications, patent, and patent documents mentioned herein are incorporated by reference herein as though individually incorporated by reference. Numerous alterations of the structure herein disclosed will suggest themselves to those skilled in the art. However, it is to be understood that the present disclosure relates to the preferred embodiments of the invention which is for purposes of illustration only and not to be construed as a limitation of the invention. All such modifications which do not depart from the spirit of the invention are intended to be included within the scope of the appended claims.

Although preferred embodiments of the present invention have been disclosed in detail herein, it will be understood that various substitutions and modifications may be made to the disclosed embodiment described herein without departing from the scope and spirit of the present invention as recited in the appended claims.

We claim:

1. A method of operating a tufting machine of the type having front and rear rows of spaced needles disposed transversely across the width of the machine, a pattern yarn feed control for supplying yarns to the needles, a needle bar shifter for shifting for the transverse rows of needles, loopers operable to seize yarns from the needles, a control system for providing pattern information to the pattern yarn feed control mechanism and the needle bar shifter comprising the steps of:

threading the front and rear transverse rows of needles with a plurality of different yarns forming a repeat;

feeding a backing fabric through the tufting machine and reciprocating the front and rear transverse rows of needles to cause the plurality of yarns to penetrate the backing fabric;

seizing the yarns penetrating the backing fabric with loopers;

laterally shifting the front and rear transverse rows of needles no more than one gauge unit;

controlling the feeding of yarns to the transverse rows of needles in accordance with the pattern information to form relatively high tufts of yarns to be displayed and relatively low tufts of yarns to be hidden.

2. The method of claim 1 wherein the spacing of the front transverse row of needles is selected from the group of $1/10^{th}$ gauge, $1/8^{th}$ gauge, $1/5^{th}$ gauge, and 5/32nds gauge.

3. The method of claim 1 wherein the needles are laterally shifted by one-half the gauge of the first transverse rows of needles.

4. The method of claim 1 wherein the backing fabric is advanced by approximately the length of the gauge of the front transverse row of needles for each reciprocation of the needles.

5. The method of claim 1 wherein the yarn feed control supplies yarn to form a single relatively high tuft for each repeat.

6. The method of claim 1 wherein the front and rear rows of spaced needles are staggered with respect to each other.

7. The method of claim 1 wherein front loopers seize yarns from the front row of needles and rear loopers seize yarns from the rear row of needles.

8. The method of claim 7 wherein the front loopers and the rear loopers are staggered with respect to each other.

9. The method of claim 1 wherein the plurality of yarns comprises two colors of yarn threaded on the front row of needles and two colors of yarn threaded on the rear row of needles.

10. The method of claim 9 wherein the tufting machine commences operation with the front and rear rows of needles at a home position and the needles are never shifted laterally by more than one gauge unit from the home position.

11. The method of claim 1 wherein the plurality of yarns comprises three colors of yarn threaded on the front row of needles and three colors of yarn threaded on the rear row of needles.

12. The method of claim 11 wherein the tufting machine commences operation with the front and rear rows of needles at a home position and the needles are never shifted laterally by more than two gauge units from the home position.

13. The method of claim 1 wherein the backing fabric is a nonwoven fabric.

14. A method of tufting a patterned fabric from a plurality of colored yarns on a tufting machine comprising the steps of:

(a) providing a tufting machine with pattern information;

(b) threading a first plurality of yarns through a yarn feed pattern control device to a front row of needles, said needles of the front row being transversely spaced apart from one another by a gauge distance and the first plurality of yarns being distributed to the needles in a first repeating color sequence;

(c) threading a second plurality of yarns through a yarn feed pattern control device to a rear row of needles, said needles of the rear row being transversely spaced apart from one another by the gauge distance and the second plurality of yarns being distributed to the needles in a second repeating color sequence;

(d) feeding a backing fabric longitudinally through the tufting machine from front to back;

(e) reciprocating the front and rear rows of needles to penetrate the backing fabric to thereby carrying loops of the first and second pluralities of yarns from a back side of the backing fabric to a face side of the backing fabric;

(f) operating loopers on the face side of the backing fabric to seize loops of the first and second pluralities of yarns;

(g) operating the yarn feed pattern control device in accordance with the pattern information to form relatively high loops and relatively low loops from the first and second pluralities of yarns such that the relatively high loops are displayed and relatively low loops are at least partially concealed;

wherein at least one yarn from each adjacent first repeating color sequence and second repeating color sequence is displayed from each reciprocation of the needles.

15. The method of claim 14 wherein the needles are shifted by no more than one gauge distance between each penetration of the backing fabric by the needles.

16. The method of claim 14 wherein the backing fabric is a nonwoven fabric.

17. The method of claim 14 wherein the front and rear rows of spaced needles are staggered with respect to each other.

18. The method of claim 14 wherein the needles are laterally shifted by one-half the gauge distance of the front transverse rows of needles.

19. The method of claim 14 wherein the backing fabric is advanced by approximately one half of the length of the gauge of the front transverse row of needles for each reciprocation of the needles.

20. The method of claim 14 wherein the first plurality of yarns comprises two colors of yarn threaded in alternating fashion on the front row of needles to form a first repeating color sequence and two colors of yarn threaded in alternating fashion on the rear row of needles to form a second repeating color sequence.

* * * * *